United States Patent [19]

Spinner

[11] 4,421,377

[45] Dec. 20, 1983

[54] CONNECTOR FOR HF COAXIAL CABLE

[76] Inventor: Georg Spinner, Am Eichberg 12, D-8155 Westerham, Fed. Rep. of Germany

[21] Appl. No.: 304,821

[22] Filed: Sep. 23, 1981

[30] Foreign Application Priority Data

Sep. 25, 1980 [DE] Fed. Rep. of Germany ..... 3036215

[51] Int. Cl.[3] ..... H01R 17/18

[52] U.S. Cl. ..... 339/177 R; 29/827; 174/75 C

[58] Field of Search ..... 339/177 R, 177 E, 143; 174/75 C, 88 C; 29/827, 857

[56] References Cited

U.S. PATENT DOCUMENTS 3,336,563 8/1967 Hyslop ..... 339/DIG. 1

3,544,705 12/1970 Winston ..... 339/75 C

FOREIGN PATENT DOCUMENTS 811589 4/1959 United Kingdom ..... 339/177 R

*Primary Examiner*—Eugene F. Desmond

*Assistant Examiner*—David Pirlot

*Attorney, Agent, or Firm*—Ostrolenk, Faber, Gerb & Soffen

[57] ABSTRACT

A connector for a coaxial cable having a dielectric and an outer conductor supported by the dielectric comprises a bushing that can be emplaced between the dielectric and the outer conductor, a tension member that acts radially inward upon the outer conductor so that mechanical contact is made between the outer conductor and the outer surface of the bushing. The bushing has at least one axial slot. A cut leading edge of the outer conductor is inserted through the slot from the inner surface of the bushing after the bushing is placed over the outer conductor. The bushing and slot are configured so that the outer conductor passes through the slot and wraps around the bushing upon relative rotation of the bushing and the coaxial cable.

16 Claims, 3 Drawing Figures

CONNECTOR FOR HF COAXIAL CABLE

BACKGROUND OF THE INVENTION

The invention relates to a connector for high frequency coaxial cables. It also relates to a bushing used in such connectors which can be inserted between the dielectric and the outer conductor of such a cable. It further relates to a process for assembly of such a bushing to a coaxial cable. Such connectors are known, from German DE-OS Nos. 20 33 083 and DE-PS 10 75 699 for example. The contact bushing of the connector in the former document is a tapering ring, whereas in the latter it is a tapered bushing with outside teeth. Both types of contact bushing are inserted axially between the outer conductor and the dielectric of the cable. The outer conductor is a relatively thick-walled, corrugated or sturdily braided tube that can readily be secured with a clamping ring or similar device.

This type of contact, which simultaneously involves mechanical and electrical connection, is however not possible with coaxial cables that have a thin-walled outer conductor of copper, foil or thin sheet copper for example. Such cables are common today in cable-television distribution networks, where an outer-contact shield is soldered along the cable to make it impermeable to high-frequencies. This shield is too close to the dielectric, which is made of polyethylene or a similar material, for a contact bushing to be inserted between the dielectric and the outer foil conductor without damaging the latter, and proper contact would not be ensured. This is why the jacket, which surrounds the outer conductor, as well as, if necessary, the inner conductor or dielectric has been used in the past to connect the cable mechanically, with electrical contact being made by spring contacts provided on the outer conductor which contacts permit the connector and outer conductor to slide together. Such connectors are disclosed in German Nos. DE-PS 21 33 392, DE-OS 21 34 304 and 23 31 610.

Other cable connectors are known that have mechanisms that clamp onto the conductor and simultaneously perform the functions of making contact and connecting the cable mechanically. This is possible with thin-walled outer conductors that are strong enough, as is the case for some cables with outer conductors of foil. Such cables are fastened by soldering or by clamping with tapering outside ring clamps, or by metal pieces inserted into the jacket to ensure positive contact. Spring and crimping connectors are also well known.

The known methods either require special tools such as crimping tools or have the drawback of damaging the jacket to the extent that it might not be able to resist sufficiently being pulled. Another disadvantage is that these methods result in deformations that lead to increased reflection.

The sliding-contact connectors mentioned above do not of course have these disadvantages, although the outer conductor can not be employed to assist in strain relief.

SUMMARY OF THE INVENTION

The present invention provides a cable connector that has a contact bushing, that ensures perfect electrical contact, that relieves strain, that can be applied without special tools, and that will not involve a clamp connection of the type that causes deformations that degrade the reflection coefficient at the point of connection. These advantages are achieved by using a bushing that is inserted between the dielectric and the outer conductor of the cable, is clamped by a tension member that acts radially on it from outside the outer conductor, and has at least one axial slot into which a thin-walled outer conductor which has been provided with a longitudinal slit can be inserted, by twisting the bushing around the cable. The insertion takes place after the bushing has been slid over the end of the cable.

To simplify threading the outer conductor at the edge of the slot, the slot plane is positioned at the widest possible angle or perpendicular to the radial plane, extending, in other words, largely tangentially to a geometrical chord next to the inside wall of the bushing. When only one slot is employed, it can extend along the entire axial length of the bushing. A preferred embodiment of the connector, however, has two slots at opposite directions to each other in the slit plane, which lies preferably on a common chord. This enables the bushing to be screwed into the outer conductor either clockwise or counterclockwise as preferred, in accordance with which edge seems to be made appropriate. When there are several slots, they can only of course extend along part of the length of the bushing, preferably up to a flange on the end of the bushing.

It is easy to make the required slit in the conductive jacket ahead of time with a knife, and a contact bushing according to the invention can be twisted in under the jacket of the cable. The outside of a bushing that is to be contoured or inserted in this way should be beaded to deform the jacket outside the cylindrical contact bushing (by use of a piece of flexible plastic for example) when the connector housing is being screwed together, sufficiently to ensure a perfect positive connection.

Twisting the contact bushing only partly into the outer conductor will be adequate to provide both electrical and mechanical connection, although it is preferable to screw it in completely.

BRIEF DESCRIPTION OF THE DRAWINGS

One embodiment of the invention will now be described with reference to the drawings in which.

DETAILED DESCRIPTION OF THE PREFERRED EMBODIMENT

Figure 1:
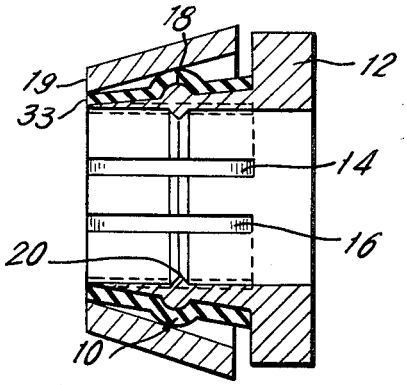
FIG. 1 is an axial section through an outer-conductor contact bushing and other components of a connector in accordance with the invention.
Figure 2:
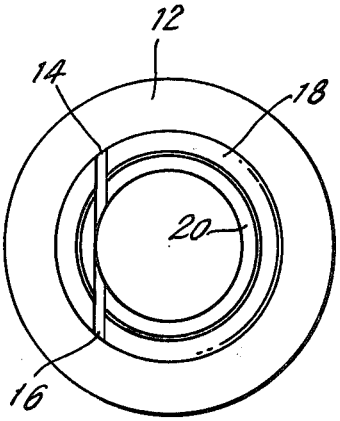
FIG. 2 is an axial view of the contact bushing in FIG. 1.

The outer-conductor contact bushing 10 in FIGS. 1 and 2 has a flange 12 that snaps axially into the other parts of the connector, which are not shown. The illustrated embodiment of bushing 10 has two slots 14 and 16 parallel to the axis. The plane of these slots passes through a geometrical chord near the inside circumference of the bush, extending tangentially to the opening which receives the dielectric, so that the outer conductor of the cable can be twisted with minimum resistance through the slots.

The outside of the tapered bushing 10 has a bead 18 that works with a tension member, shown schematically, to provide positive axial support of the outer conductor, which fits over the outer circumferential surface of bushing 10. The cylindrical inside surface of the bushing has an annular rib 20 that cuts into the cable dielectric. Alternatively bead 18 or annular rib 20 may be formed as part of inner and outer contours of bushing 10 formed as self-tapping threads.

Figure 3:
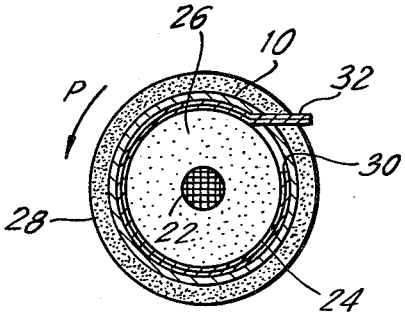
FIG. 3 is a section through the contact bushing in FIGS. 1 and 2 as screwed into the outer conductor of a cable.

FIG. 3 is a cross-section of a coaxial cable that consists of an inner conductor 22, an outer conductor 24, a dielectric 26 between the two conductors, and an outer protective jacket 28. At the point of electrical contact, jacket 28 has been stripped from outer conductor 24, which is slit longitudinally at that point by a slit 30. Bushing 10 is slid axially over outer conductor 24 and twisted. In FIG. 3, bushing 10 has been twisted counterclockwise in the direction shown by arrow P relative to the cable, which was not rotated. The edge 32 of slit 30 in the outer conductor will slip into slot 14 in the bushing in such a way that continued twisting will seat the bushing between outer conductor 24 and dielectric 26. One complete turn will position the whole bushing completely inside the outer conductor, with rib 22 cutting into the dielectric, which will then be able to accept part of the axial force that occurs. A tension member, such as member 19 of FIG. 1 is slipped in a known way axially over the outer connector as it lies over bead 18. Tapered and slotted tension sleeves or other parts may be used for this purpose. A portion which mates with bead 18 may be part of the tension member that fits over the bushing, forming both a positive and non-positive mechanical connection. In many cases, however, the friction resulting from a clamp-type connection will be adequate, by itself, to hold the connection together.

The contact bushing only really needs one slot 14 to perform the function described above. It is nevertheless practical for the bushing to have two opposite slots so that the cable can be twisted in either clockwise or counterclockwise. If there are two slots 14 and 16, they can lie along a chord (which facilitates slitting the cable) or along different chords.

In a preferred embodiment of the invention, the outer conductor may be clamped to bushing 10 as a result of the action of a member 33 comprised of an elastic material that is stretched axially and/or radially inside the connector housing, deforming to correspond with the outer contour of bushing 10 and providing the necessary radial force.

I claim:

1. A connector for a coaxial cable which includes an inner conductor, a dielectric layer around the inner conductor and an outer conductor supported by the dielectric layer, the connector comprising:

a bushing for making mechanical contact with the outer conductor;

the bushing having an inner surface and an outer surface, and at least one slot extending axially along the bushing and passing between the inner surface and the outer surface; the slot lying in a plane tangential to the inner surface of the bushing; the bushing being emplaceable over the outer conductor, and the slot therein being for receiving a cut leading edge of the outer conductor, and the bushing and slot being configured so that a portion of the outer conductor having the cut leading end thereof received in the slot passes through the slot upon relative rotation of the bushing and the coaxial cable.

2. The connector of claim 1, comprising two of the slots, the slots lying in a common plane and extending in opposite directions from the inner surface of the bushing.

3. The connector of claim 1 in which the outer surface of the bushing comprises at least one external contour protrusion to make contact with the outer conductor of the coaxial cable.

4. The connector of claim 3 in which the external contour protrusion is a bead.

5. The connector of claim 3 in which the external contour protrusion is in the form of a self-tapping thread.

6. The connector of claim 1 in which the inside surface of the bushing comprises at least one internal contour protrusion that cuts into the dielectric.

7. The connector of claim 6 in which the internal contour protrusion is in the form of a self-tapping thread.

8. The connector of claim 6 in which the internal contour protrusion is formed as an annular rib.

9. The connector of claim 1, further comprising an elastic material stretchable over the bushing and the outer conductor when the outer conductor is disposed on the outer surface of the bushing.

10. The connector of claim 9 in which the elastic material conforms substantially to the shape of the bushing when stretched over the outer conductor.

11. The connector of claim 1 further comprising a tension member that acts radially inward upon the outer conductor, forcing it into contact with the bushing.

12. An assembly of a coaxial connector and a coaxial cable comprising:

an inner conductor of the coaxial cable;

a dielectric layer of the coaxial cable around the inner conductor;

an outer conductor of the coaxial cable supported by the dielectric, the connector comprising:

a bushing for making mechanical contact with the outer conductor;

the bushing having an inner surface and an outer surface, and at least one slot extending axially along the bushing and passing between the inner surface and the outer surface; the bushing being emplaceable over the outer conductor, and the slot therein being for receiving a cut leading edge of the outer conductor, and the bushing and slot being configured so that a portion of the outer conductor having the cut leading end thereof received in the slot from the inner surface of the bushing passes through the slot upon relative rotation of the bushing and the coaxial cable;

at least a portion of the outer conductor having the slit leading end extending through the slot and being disposed on the outer surface of the bushing.

13. The assembly of claim 12, further comprising an elastic material stretchable over the bushing and the outer conductor when at least the portion of the outer conductor is disposed on the outer surface of the bushing.

14. The assembly of claim 12, further comprising a tension member that acts radially inward upon the portion of the outer conductor, forcing it into contact with the bushing.

15. A process for assembly of a coaxial cable which includes an inner conductor, a dielectric layer around the inner conductor and an outer conductor supported by the dielectric layer and a bushing having a slot extending axially along the bushing between an inner and outer surface of the bushing, said process comprising the steps of:

(a) cutting the outer conductor to form a slit leading edge, (b) placing the bushing over the outer conductor, (c) inserting the slit leading edge into the axial slot from the inner surface of the bushing and (d) relatively rotating the bushing and the coaxial cable so that at least a portion of the outer conductor having the slit leading end passes through the slot and wraps around the bushing.

16. The process of claim 15 in which the outer conductor is cut axially so that the slit leading edge is axially disposed.

* * * * *